US009675841B2

(12) United States Patent
Wu

(10) Patent No.: US 9,675,841 B2
(45) Date of Patent: Jun. 13, 2017

(54) WAIST FITNESS APPARATUS

(71) Applicant: Dong-Her Wu, Changhua (TW)

(72) Inventor: Dong-Her Wu, Changhua (TW)

( * ) Notice: Subject to any disclaimer, the term of this patent is extended or adjusted under 35 U.S.C. 154(b) by 0 days.

(21) Appl. No.: 14/952,114

(22) Filed: Nov. 25, 2015

(65) Prior Publication Data

US 2017/0050068 A1 Feb. 23, 2017

(30) Foreign Application Priority Data

Aug. 19, 2015 (TW) ..... 104213387 U

(51) Int. Cl.
*A63B 26/00* (2006.01)
*A63B 21/02* (2006.01)
(Continued)

(52) U.S. Cl.
CPC ..... *A63B 23/0211* (2013.01); *A63B 22/14* (2013.01); *A47C 9/002* (2013.01); *A63B 21/00047* (2013.01); *A63B 21/02* (2013.01); *A63B 21/0421* (2013.01); *A63B 21/0435* (2013.01); *A63B 21/4029* (2015.10);
(Continued)

(58) Field of Classification Search
CPC . A63B 21/00047; A63B 21/02; A63B 21/028; A63B 21/04; A63B 21/0407; A63B 21/0421; A63B 21/0435; A63B 21/045; A63B 21/0455; A63B 21/0608; A63B 21/4027; A63B 21/4029; A63B 21/4031; A63B 21/4041; A63B 21/4043; A63B 21/4047; A63B 21/4049; A63B 22/0087; A63B 22/0089; A63B 22/14; A63B 22/18; A63B 23/00; A63B 23/0211; A63B 2023/003; A63B 2023/006; A63B 2023/02; A63B 2023/0205; A63B 2023/0211; A63B 2023/0222; A63B 71/0054; A63B 2071/0063; A63B 2071/0072; A63B 2071/0081; A63B 2071/009; A63B 2208/0228; A63B 2208/0233; A47C 9/002
See application file for complete search history.

(56) References Cited

U.S. PATENT DOCUMENTS 4,369,969 A * 1/1983 Straub ..... A63B 23/03575 482/142
5,088,473 A * 2/1992 Chen ..... A61H 1/0292 601/26
(Continued)

FOREIGN PATENT DOCUMENTS

CN 201073118 Y * 6/2008

*Primary Examiner* — Joshua Lee
(74) *Attorney, Agent, or Firm* — Che-Yang Chen; Law offices of Scott Warmuth

(57) ABSTRACT

A waist fitness apparatus includes main body and a resilient cover. The main body has a base pivotally connected with a supporting board through an eccentric unit, and the base is used to distribute the weight of the user, so the main body can be stably disposed on the ground. The present invention is advantageous because the height of the supporting board is higher than the height of the knee height of an average adult, the user does not have to bend the knees when sitting on it to increase the comfortableness. Also, the supporting board can be dragged back to its original position by the cover when it is not in use, so the user does not have to adjust the supporting board.

6 Claims, 15 Drawing Sheets

(51) Int. Cl.

| | |
|---|---|
| ***A63B 21/04*** | (2006.01) |
| ***A63B 23/02*** | (2006.01) |
| ***A63B 22/14*** | (2006.01) |
| *A63B 21/00* | (2006.01) |
| *A63B 22/00* | (2006.01) |
| *A63B 22/18* | (2006.01) |
| *A63B 23/00* | (2006.01) |
| *A47C 9/00* | (2006.01) |

(52) U.S. Cl.
CPC ..... *A63B 21/4031* (2015.10); *A63B 21/4047* (2015.10); *A63B 21/4049* (2015.10); *A63B 22/0087* (2013.01); *A63B 22/0089* (2013.01); *A63B 22/18* (2013.01); *A63B 2023/003* (2013.01); *A63B 2208/0228* (2013.01); *A63B 2208/0233* (2013.01)

(56) References Cited

U.S. PATENT DOCUMENTS 5,496,246 A * 3/1996 Pierre ..... A63B 21/023 482/130
5,695,439 A * 12/1997 Lin ..... A63B 22/0061 482/146
6,676,579 B1 * 1/2004 Lin ..... A63B 22/0012 482/146
7,156,790 B2 * 1/2007 Johnsen ..... A63B 21/0004 482/112
9,254,415 B2 * 2/2016 Ha ..... A63B 23/03508
2005/0101449 A1 * 5/2005 Fan ..... A63B 22/14 482/57
2006/0166796 A1 * 7/2006 Armstrong ..... A63B 21/055 482/121
2009/0230743 A1 * 9/2009 Derakhshan ..... A47C 9/002 297/329
2009/0261637 A1 * 10/2009 Schmitz ..... A47C 1/03255 297/217.2
2011/0281701 A1 * 11/2011 Zhang ..... A63B 22/14 482/146
2013/0005547 A1 * 1/2013 Wang ..... A63B 22/18 482/142
2015/0111707 A1 * 4/2015 Yan ..... A63B 19/00 482/78
2015/0174450 A1 * 6/2015 Jhang ..... A63B 22/18 482/146

* cited by examiner

WAIST FITNESS APPARATUS

FIELD OF THE INVENTION

The present invention relates to a waist fitness apparatus, and more particularly to waist fitness apparatus that is able to automatically restore to its original position after use.

BACKGROUND OF THE INVENTION

Referring to FIG. 18, a conventional waist fitness apparatus (30) may include a base (31) and a rotating plate (32) on top of the base (31). The user can sit on the rotating plate (32) to exercise his/her waist. However, the conventional waist fitness apparatus is disadvantageous because (i) the user has to bend his/her knees to sit on the rotating plate (32), which may make the user feel uncomfortable, and (ii) the user may not be able to extend the legs when sitting on the rotating plate (32) with bent knees, and if the user stays with this posture for a long period of time, a sport injury may result.

FIG. 19 shows another conventional waist fitness apparatus (40), which has a base (41) including four short bars (411) at the bottom thereof to put on the ground. A curved handle is protruding to pivotally connect to a seat (43) for the user to sit and rotate the body thereon, so the user can exercise the waist portion of the body. However, the conventional waist fitness apparatus (40) may be disadvantageous because (i) the user still has to sit with bent knees even with short bars (411); (ii) the seat (43) cannot be disposed at a fixed position the base (41), the curved handle (42), and the seat (43) are all movable, so the user has to position the seat (43) first before sitting on, which may cause some inconvenience for the user; and (iii) the curved bar (42) is exposed outside, which may be covered by dust to adversely affect the function thereof.

The above mentioned problems of conventional waist fitness apparatus have been fixed in a Taiwanese Patent Application (Publication No.: 201505586) disclosing a waist fitness apparatus (50), which has supporting legs (51) that has a curved bar (52) on top to connect with a rotating plate (53), and a seat (54) is disposed on top of the rotating plate (53). However, the waist fitness apparatus (50) still has problems such as (i) the curved bar (52) is still exposed to the external environment; and (ii) the user can hold on to a handle (541) of the seat (54) when doing the waist exercise, however, the handle (541) may disperse the focus on the waist exercise and may cause sport injury to the user's arms. Therefore, there remains a need for a new and improved design for a waist fitness apparatus to overcome the problems presented above.

SUMMARY OF THE INVENTION

In one aspect, the present invention provides a waist fitness apparatus having main body and a resilient cover, wherein the main body has a base pivotally connected with a supporting board through an eccentric unit, and the base is used to distribute the weight of the user, so the main body can be stably disposed on the ground. With the eccentric unit, the supporting board is disposed slightly higher than an average person's knee height. The resilient cover has a top edge and a bottom edge, which are engaged at an outer periphery of the supporting board and the base respectively. Namely, the cover provides a full area coverage to isolate the eccentric unit between the base and the supporting board from outside. Because of the resilient cover, the supporting board can be guided to a fixed position when it is not used. In one embodiment, the supporting board is provided for the user to sit on. In another embodiment, the supporting board has a soft seat for the user to sit on to increase the comfort level.

Comparing with conventional waist fitness apparatuses, the present invention is advantageous because (i) the height of the supporting board is higher than the height of the knee height of an average adult, the user does not have to bend the knees when sitting on it to increase the comfortableness; (ii) the height of the supporting board is higher than the height of the knee height of an average adult, the user does not have to bend the knees and the user's both legs can be supported by the ground to effectively drive the supporting board using the lower body to avoid sports injuries; (iii) the supporting board can be dragged back to its original position by the cover when it is not in use, so the user does not have to adjust the supporting board; (iv) the use of the cover can prevent the eccentric unit from dust or other external objects; and (v) when the fitness apparatus is in use, both legs of the user are supported by the ground, so it is unnecessary to install other equipment such as hand rails.

DETAILED DESCRIPTION OF THE INVENTION

Figure 1:
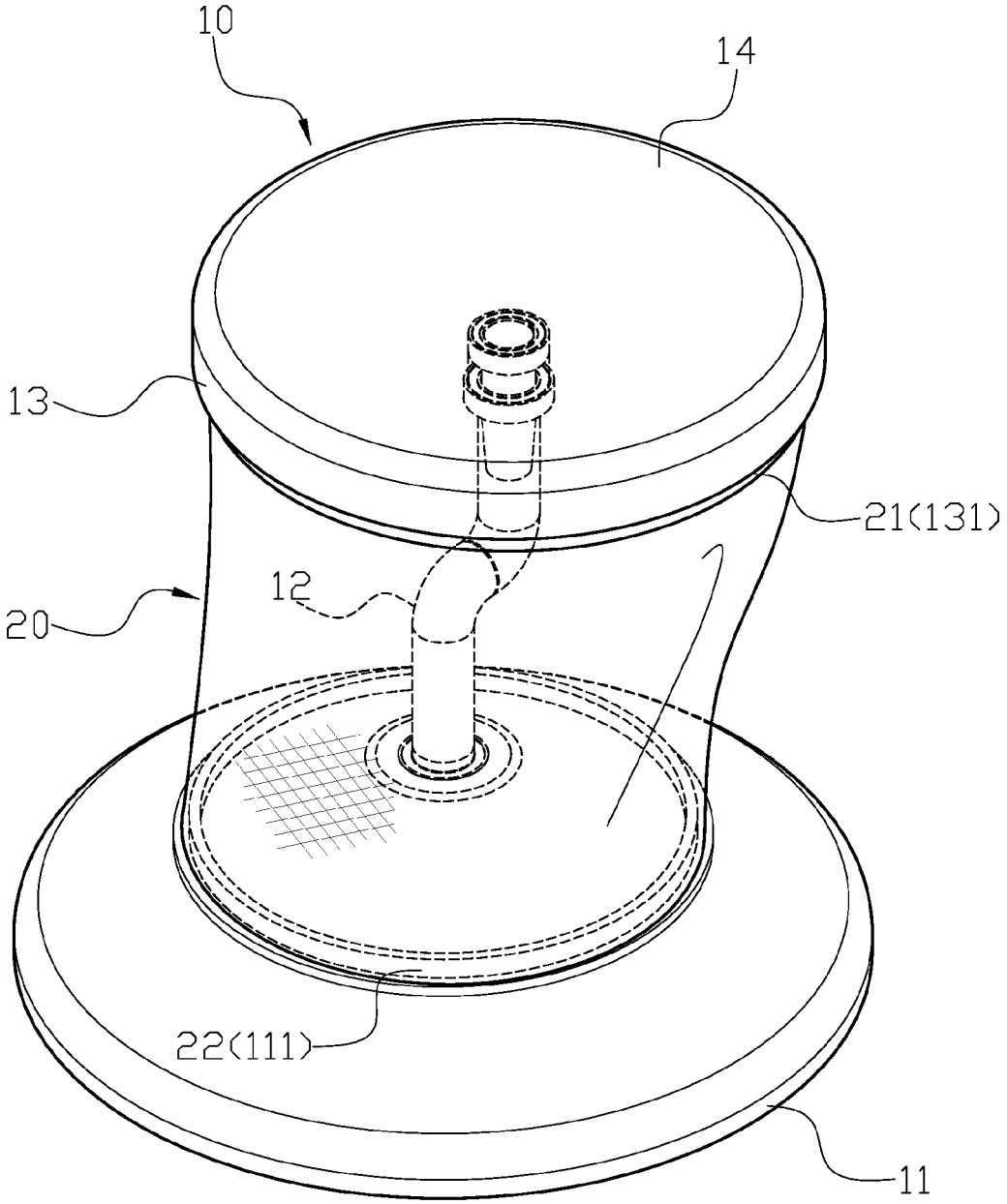
FIG. 1 is a three-dimensional view of the waist fitness apparatus in the present invention.
Figure 2:
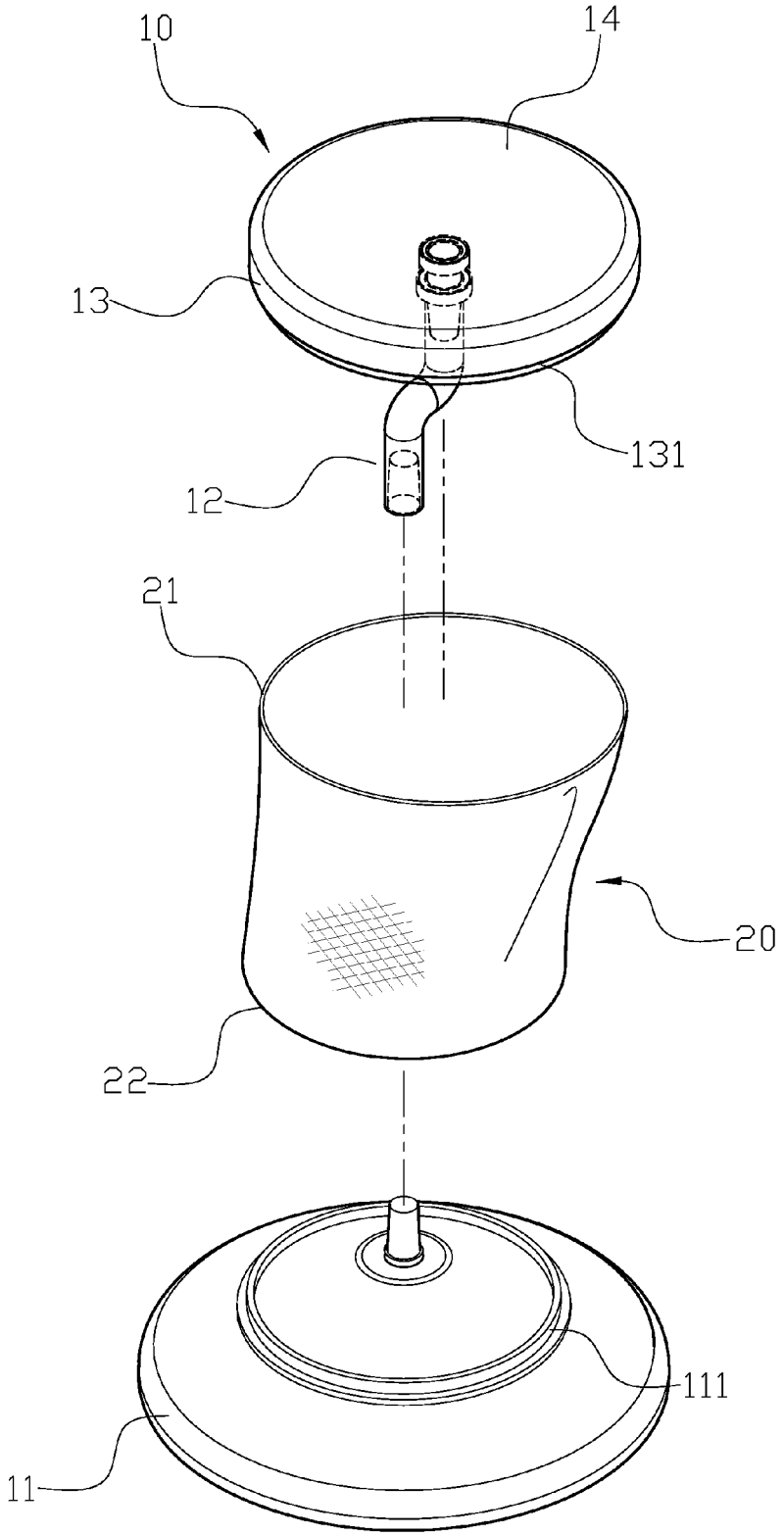
FIG. 2 is a three-dimensional exploded view of the waist fitness apparatus in the present invention.
Figure 3:
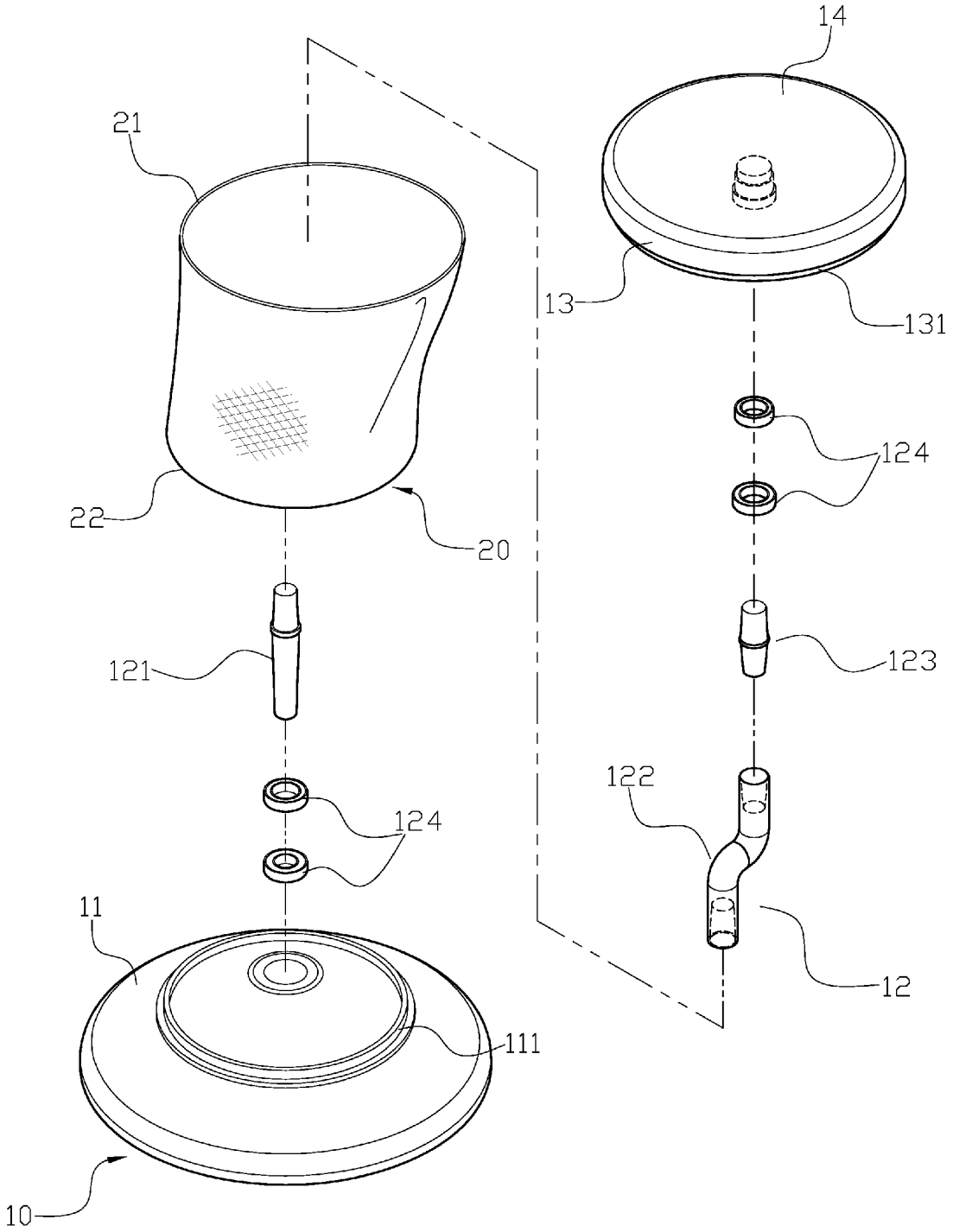
FIG. 3 is another exploded view of the waist fitness apparatus in the present invention.
Figure 4:
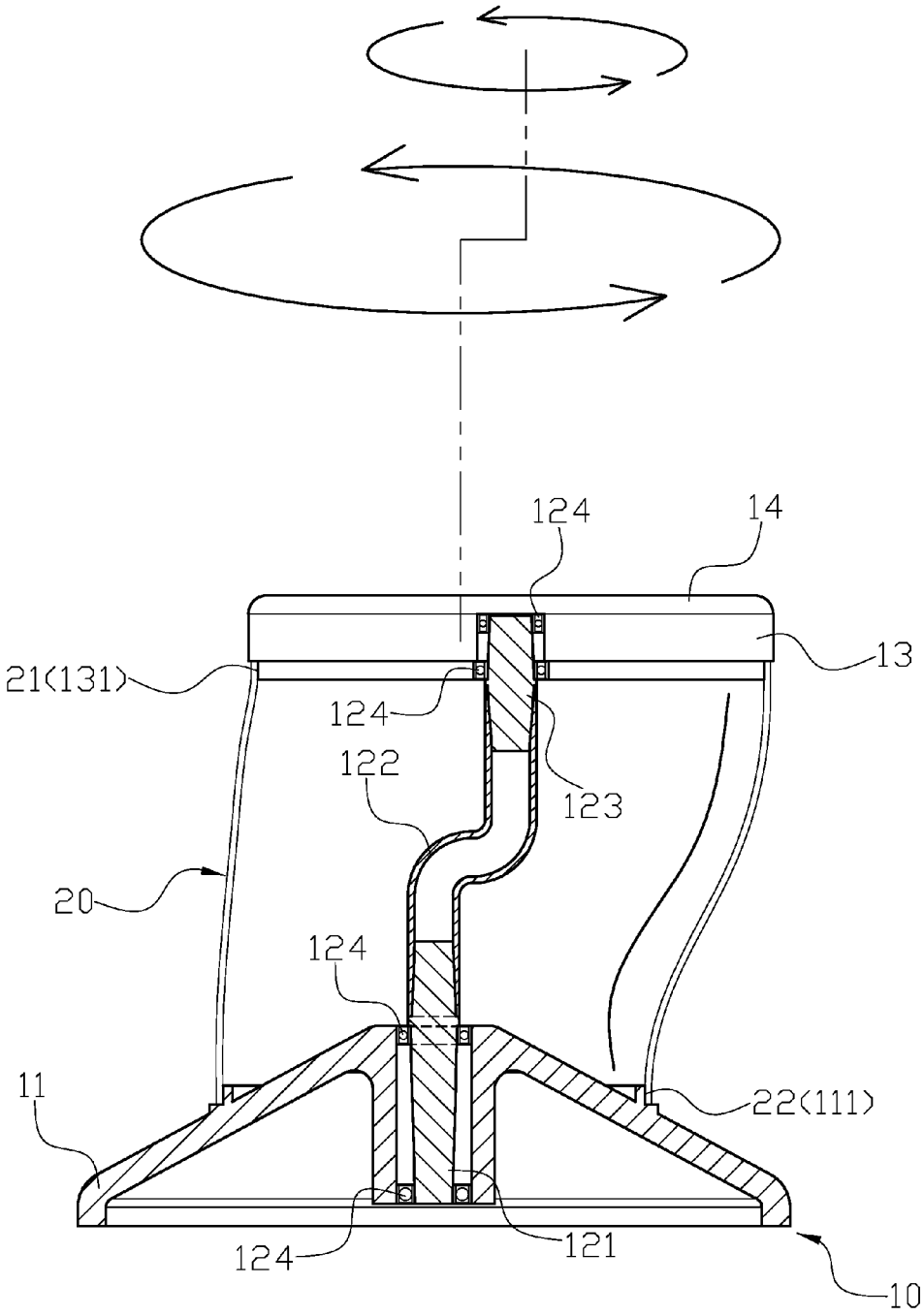
FIG. 4 is a sectional view of the waist fitness apparatus in the present invention.

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

In order to further understand the goal, characteristics and effect of the present invention, a number of embodiments along with the drawings are illustrated as following:

In one aspect, referring to FIGS. 1 to 4, the present invention provides a waist fitness apparatus having main body (10) and a resilient cover (20), wherein the main body (10) has a base (11) pivotally connected with a supporting board (13) through an eccentric unit (12), and the base (11) is used to distribute the weight of the user, so the main body (10) can be stably disposed on the ground. With the eccentric unit (12), the supporting board (13) is disposed slightly higher than an average person's knee height. The resilient cover (20) has a top edge (21) and a bottom edge (22), which are engaged at an outer periphery of the supporting board (13) and the base (11) respectively. Namely, the cover (20) provides a full area coverage to isolate the eccentric unit (12) between the base (11) and the supporting board (13) from outside. Because of the resilient cover (20), the supporting board (13) can be guided to a fixed position when it is not used. In one embodiment, the supporting board (13) is provided for the user to sit on. In another embodiment, the supporting board (13) has a soft seat (14) for the user to sit on to increase the comfort level.

In a further embodiment, each of the bottom portion of the base (11) and supporting board (13) has a neck portion (111) and (131) respectively, so the bottom edge (22) and top edge (21) of the cover (20) can be secured on the neck portions (111) and (131). In still a further embodiment, the resilient cover (20) is a cloth cover.

The eccentric unit (12) has a first connecting rod (121) plugged into the top center portion of the base (11) and a second connecting rod (123) plugged into the bottom center portion of the supporting board (13). The first connecting rod (121) is upwardly protruding from the base (11) while the second connecting rod (123) is downwardly protruding from the supporting board (13). A curved connector (122) is configured to connect the protruding portions of the first connecting rod (121) and second connecting rod (123). Two rings (124) are disposed between the base (11) and the first connecting rod (121), and between the supporting board (13) and the second connecting rod (123). The first connecting rod (121), the second connecting rod (123), the curved connector (122), the rings (124) and the base (11) are forming a cone-shaped structure. In one embodiment, the size of the base (11) is different from that of the supporting board (13), and the size of the base (11) is slightly larger than the supporting board (13).

Figure 5:
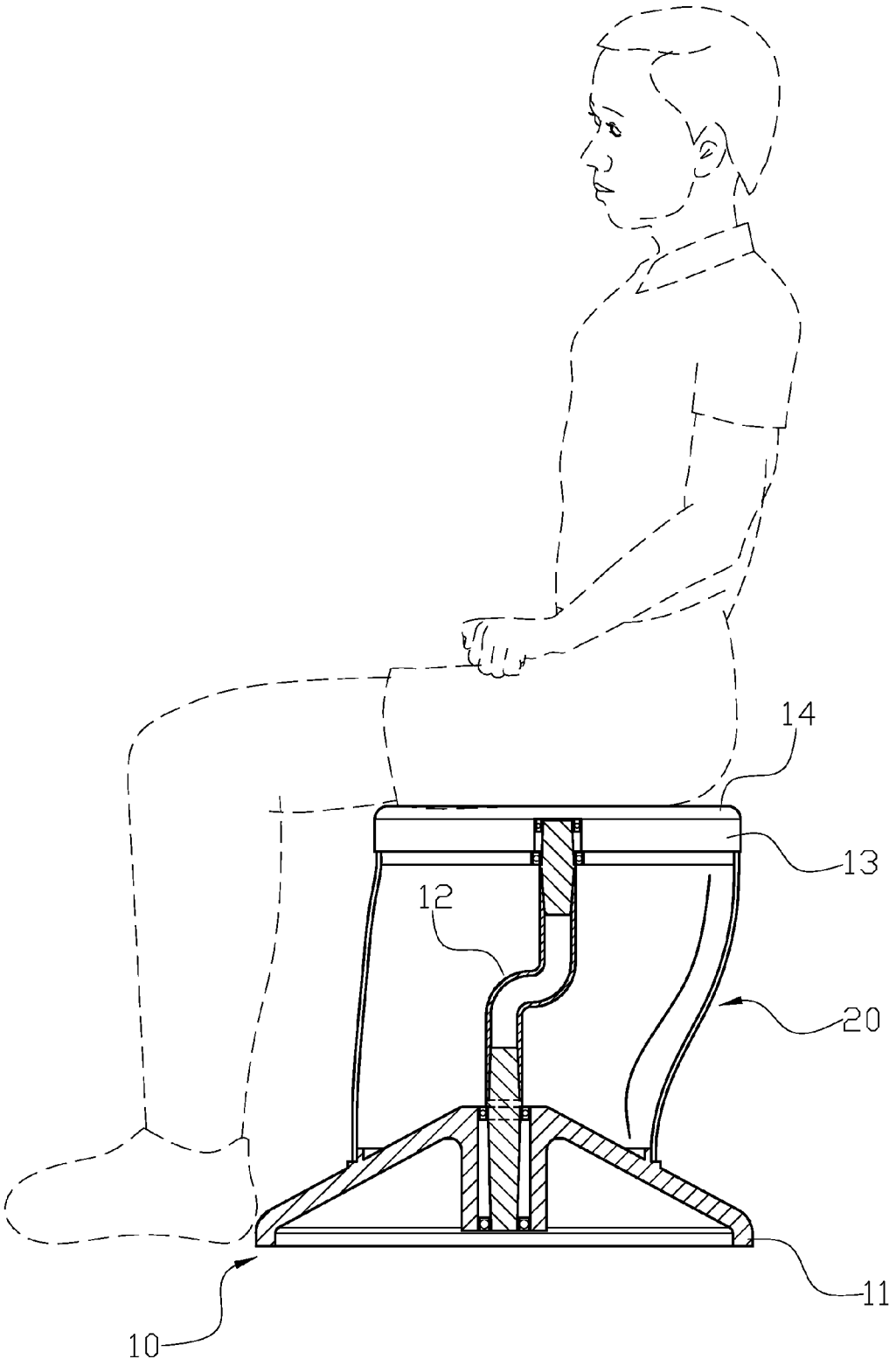
FIG. 5 is a schematic view of the waist fitness apparatus in the present invention when the user is sitting on it.
Figure 6:
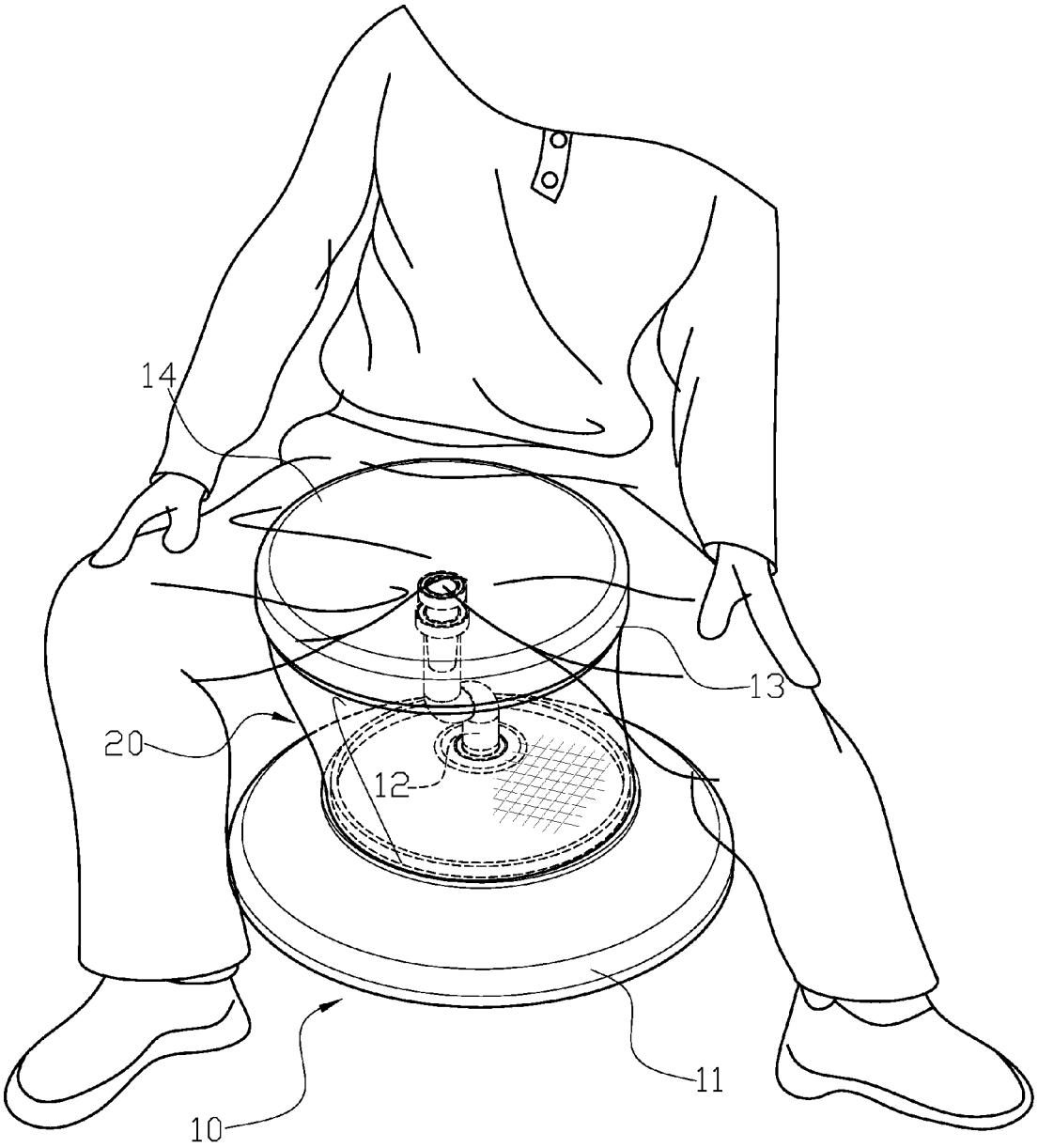
FIG. 6 is a schematic view of the waist fitness apparatus in the present invention when the user is sitting on it and twisting the body.
Figure 7:
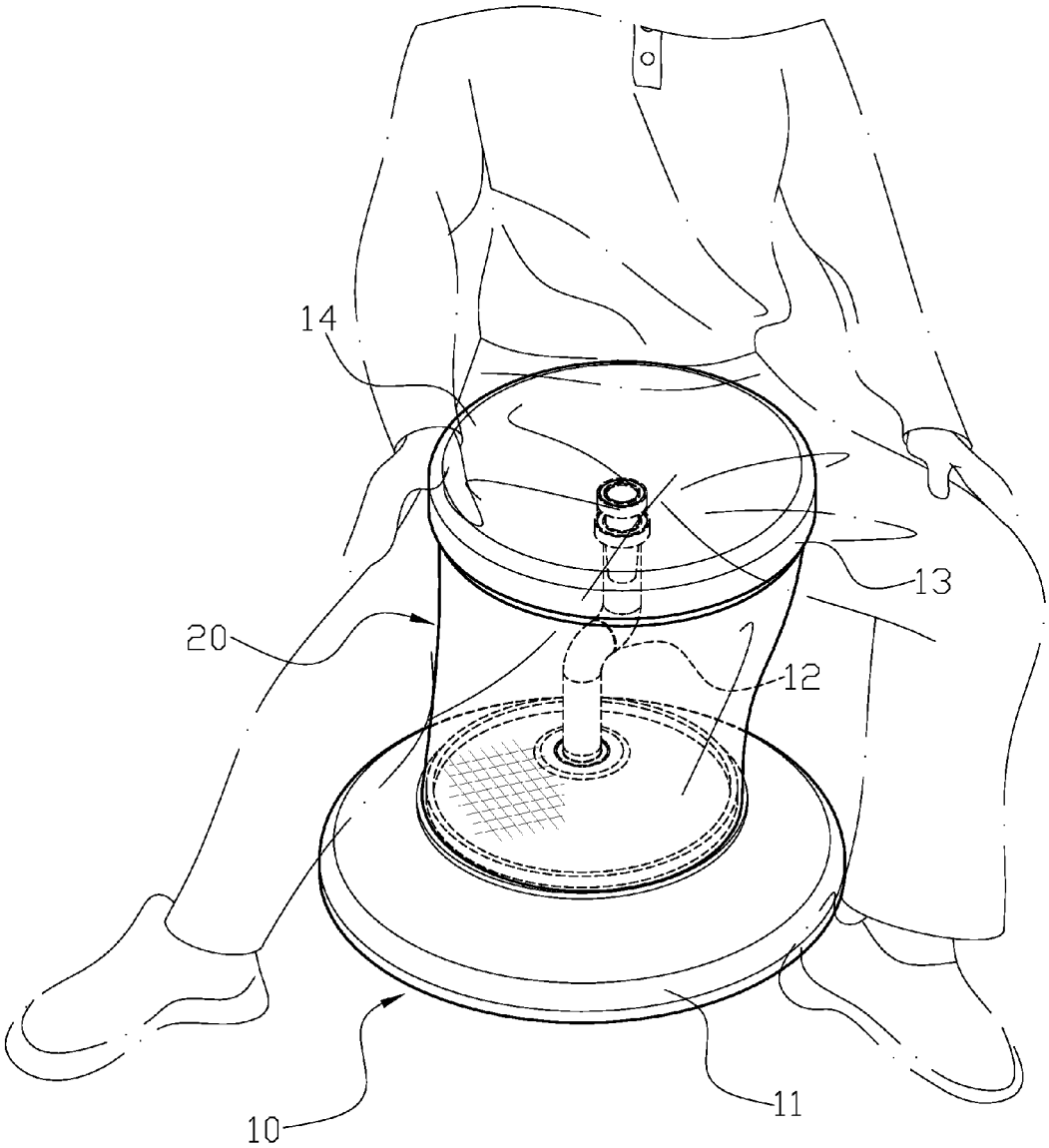
FIG. 7 is another schematic view of the waist fitness apparatus in the present invention when the user is sitting on it and twisting the body.
Figure 9:
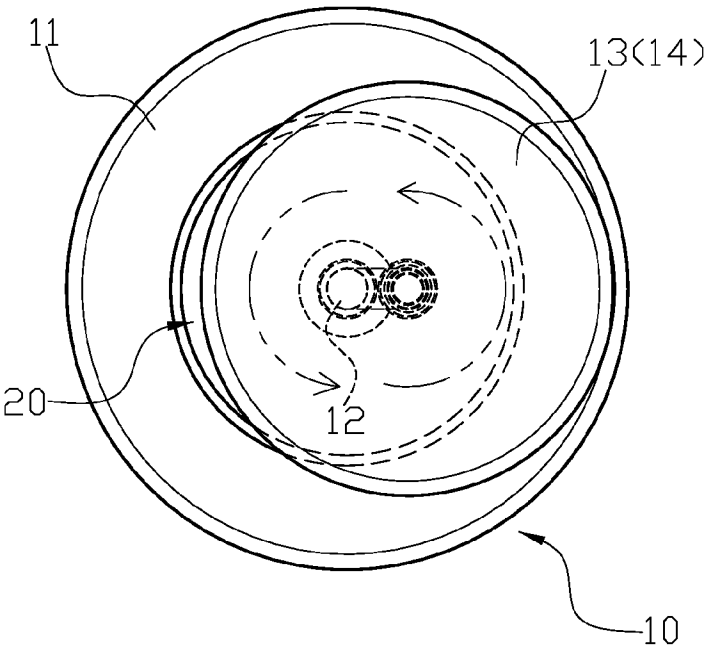
FIG. 9 is a plan view of the waist fitness apparatus in the present invention when the user is sitting on it.
Figure 8:
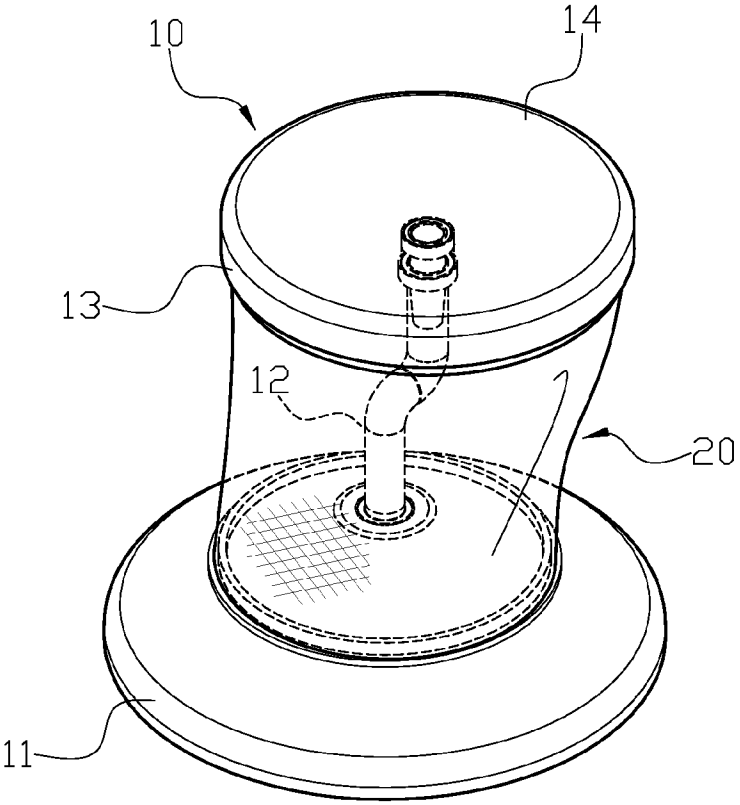
FIG. 8 is a three-dimensional view of the waist fitness apparatus in the present invention when the user is sitting on it.
Figure 11:
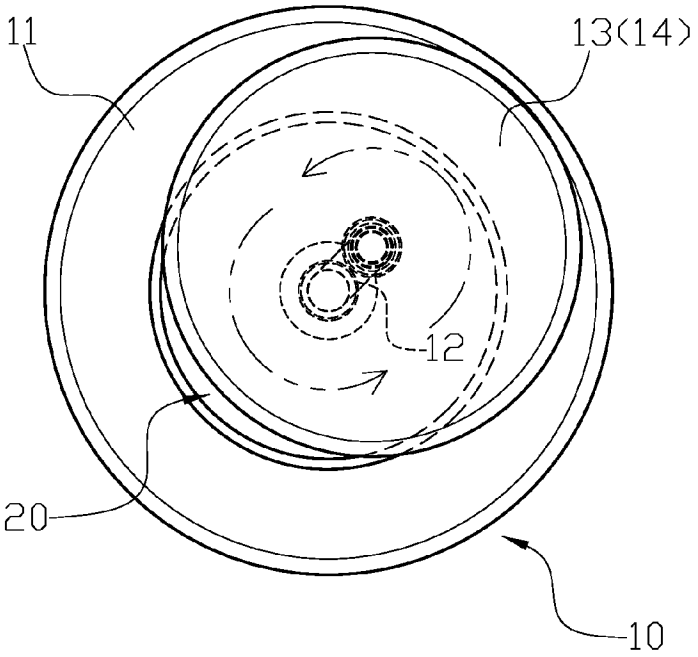
FIG. 11 is another plan view of the waist fitness apparatus in the present invention when the user is sitting on it.
Figure 10:
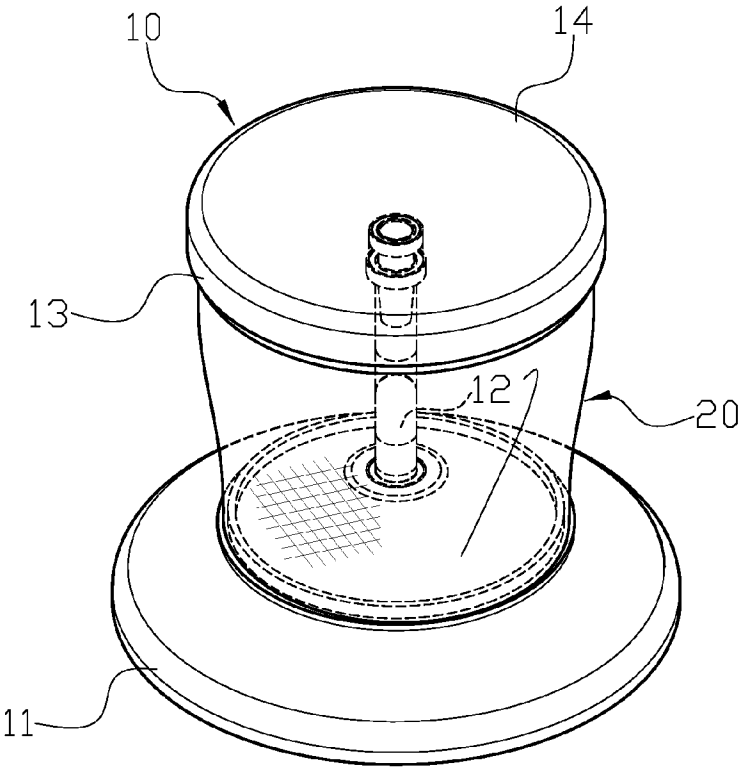
FIG. 10 is another three-dimensional view of the waist fitness apparatus in the present invention when the user is sitting on it.
Figure 13:
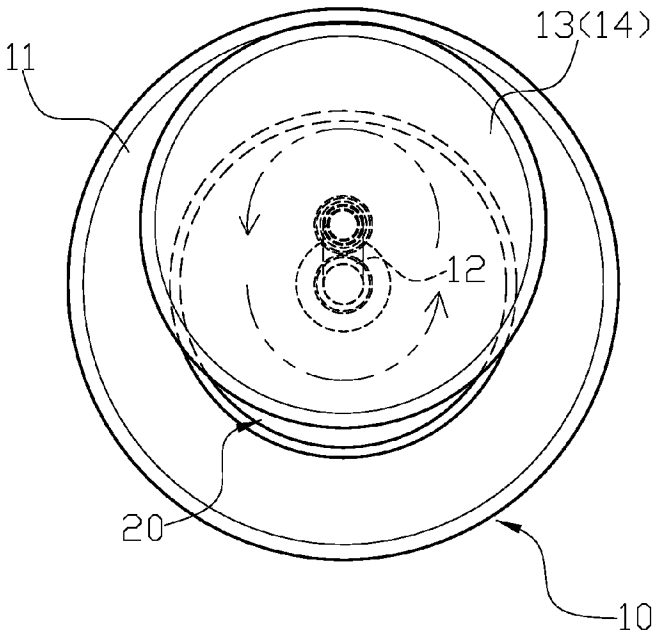
FIG. 13 is a third plan view of the waist fitness apparatus in the present invention when the user is sitting on it.
Figure 12:
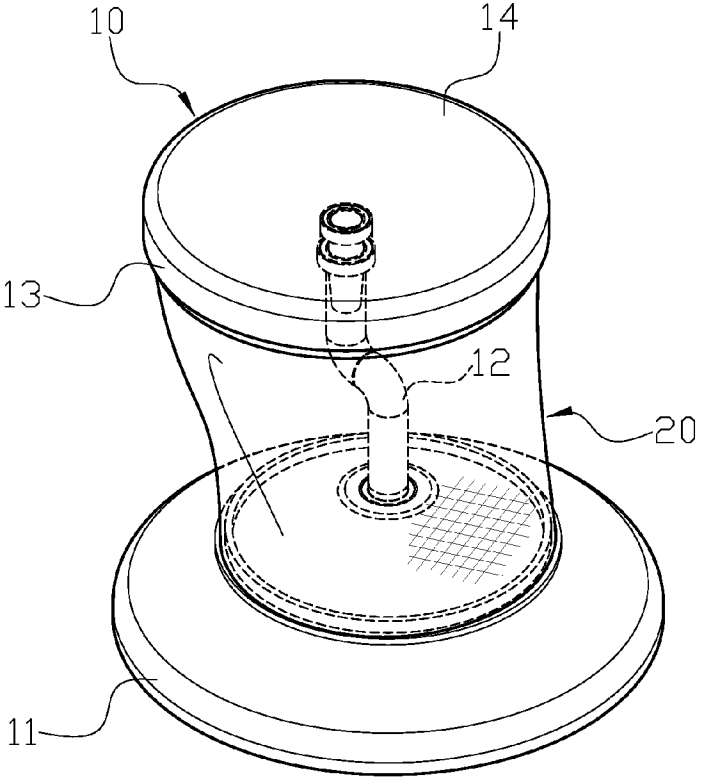
FIG. 12 is a third three-dimensional view of the waist fitness apparatus in the present invention when the user is sitting on it.
Figure 15:
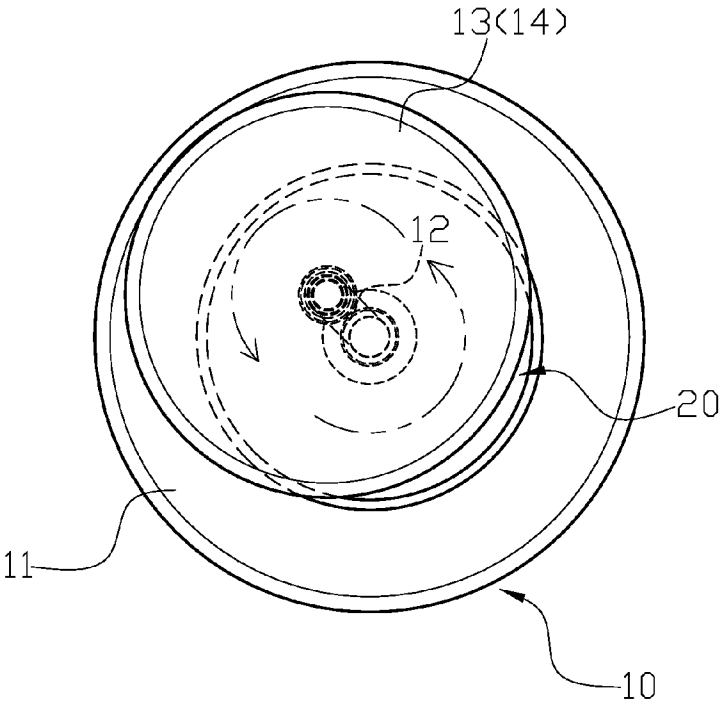
FIG. 15 is a fourth plan view of the waist fitness apparatus in the present invention when the user is sitting on it.
Figure 14:
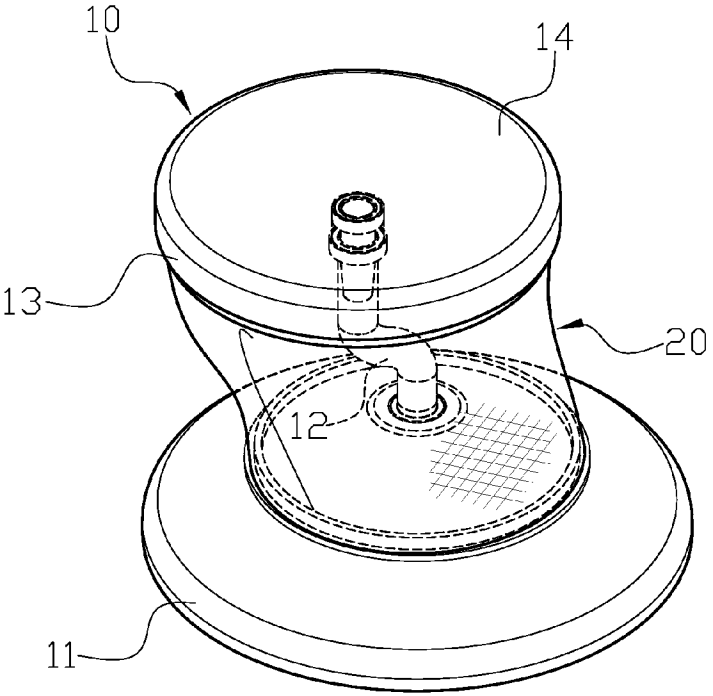
FIG. 14 is a fourth three-dimensional view of the waist fitness apparatus in the present invention when the user is sitting on it.
Figure 17:
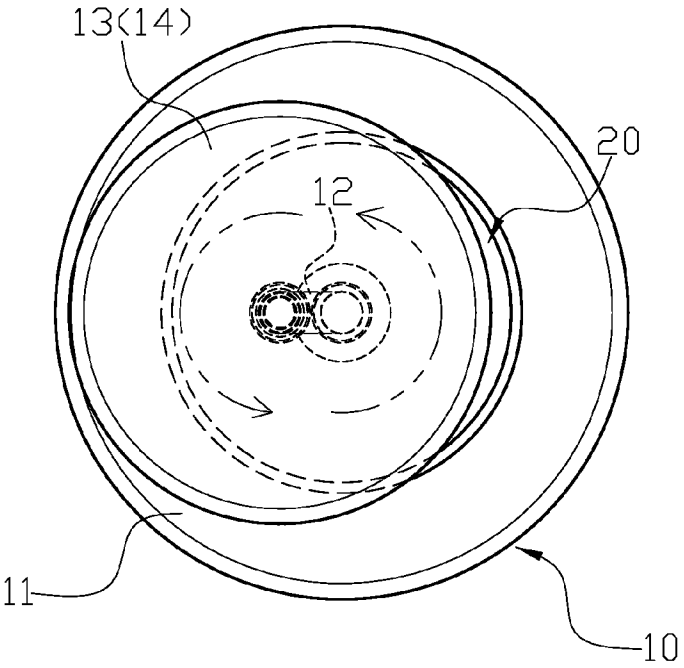
FIG. 17 is a fifth plan view of the waist fitness apparatus in the present invention when the user is sitting on it.
Figure 16:
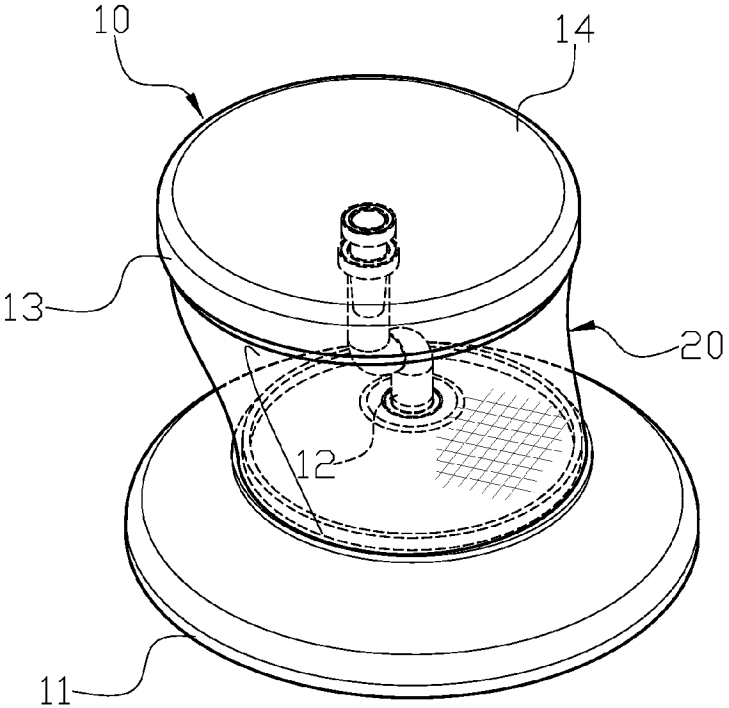
FIG. 16 is a fifth three-dimensional view of the waist fitness apparatus in the present invention when the user is sitting on it.
Figure 18:
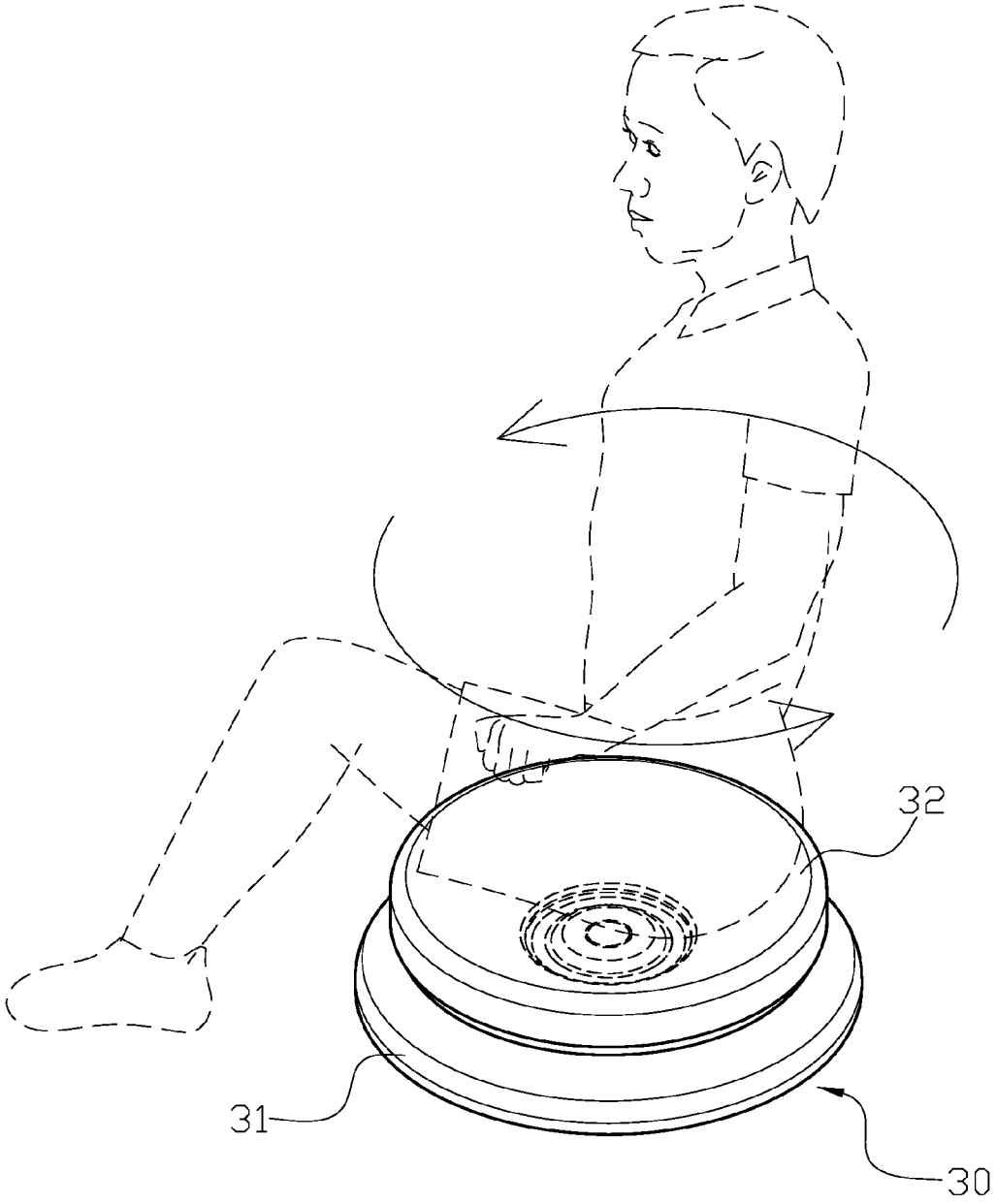
FIG. 18 PRIOR ART
FIG. 18 is a prior art.
Figure 19:
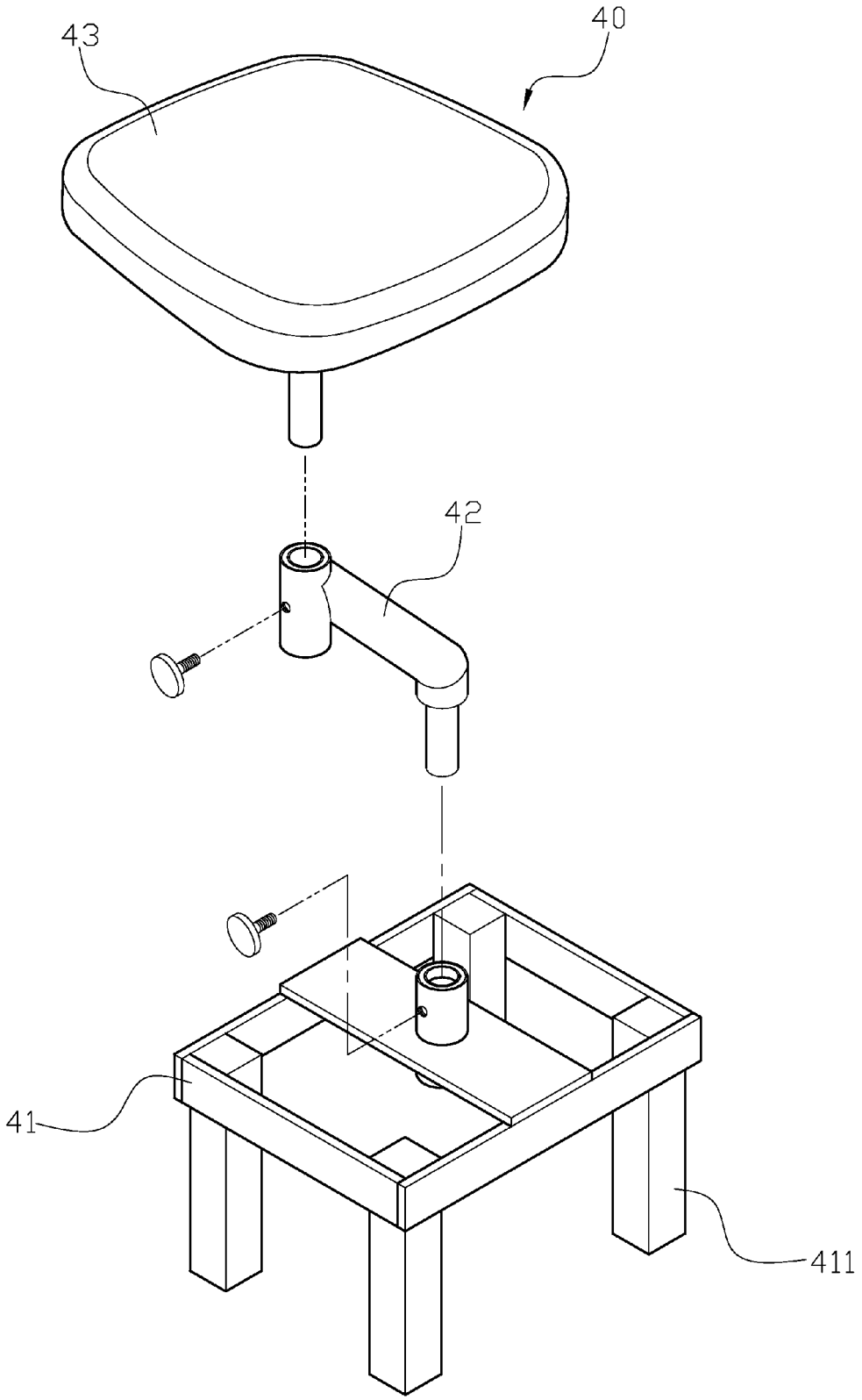
FIG. 19 PRIOR ART
FIG. 19 is another prior art.
Figure 20:
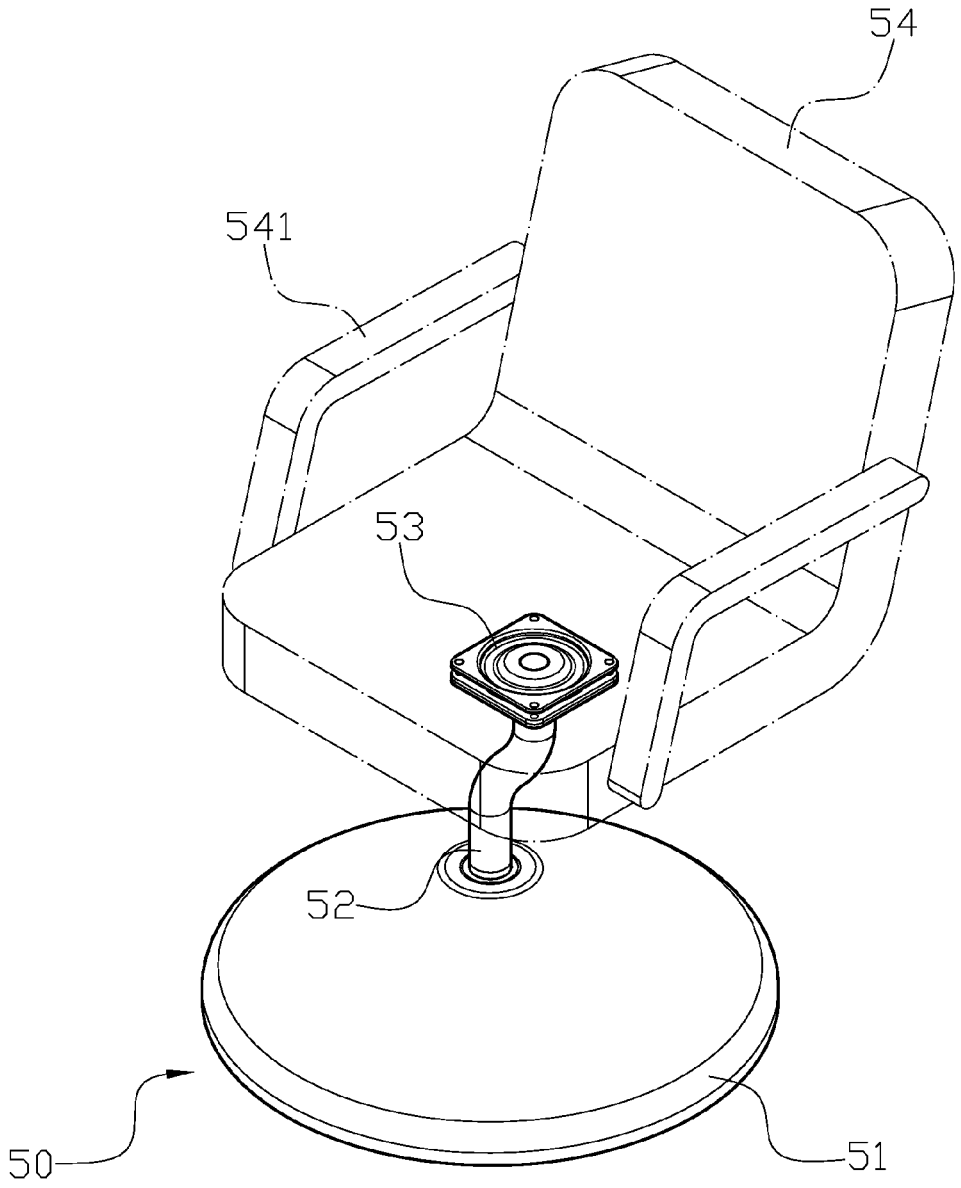
FIG. 20 PRIOR ART
FIG. 20 is still another prior art.

When in use, the supporting board (13) or the soft seat (14) are provided for the users to sit on, and the eccentric unit (12) and the base (11) are used to sustain the user's weight. Since the height of the supporting board (13) is higher than the average height of an adult's knee, so when the user sits on the supporting board (13), he/she does not have to bend the knees and both legs can fully extend (see FIG. 5). During the exercise, the user's legs can both be supported by the ground, so the user's lower body and waist can effectively drive the supporting board (13) to rotate (see FIGS. 6 and 7). When it is rotated, the curved connector (122) of the eccentric unit (12) can be more in a circulated manner according to the base (11) as an origin. The connection between the curved connector (122) and the supporting board (13) is through the second connecting rod (123), and the supporting board (13) is configured to rotate by itself on the curved connector (122) (see FIGS. 4, 17 and 18) to effectively reduce the shear force when the supporting board (13) rotates. Furthermore, with the rotation of the supporting board (13) on the second connecting rod (123), the supporting board (13) can always rotate toward one direction.

Comparing with conventional waist fitness apparatuses, the present invention is advantageous because (i) the height of the supporting board (13) is higher than the height of the knee height of an average adult, the user does not have to bend the knees when sitting on it to increase the comfortableness; (ii) the height of the supporting board (13) is higher than the height of the knee height of an average adult, the user does not have to bend the knees and the user's both legs can be supported by the ground to effectively drive the supporting board using the lower body to avoid sports injuries; (iii) the supporting board (13) can be dragged back to its original position by the cover (20) when it is not in use, so the user does not have to adjust the supporting board (13); (iv) the use of the cover (20) can prevent the eccentric unit (12) from dust or other external objects; and (v) when the fitness apparatus is in use, both legs of the user are supported by the ground, so it is unnecessary to install other equipment such as hand rails.

Having described the invention by the description and illustrations above, it should be understood that these are exemplary of the invention and are not to be considered as limiting. Accordingly, the invention is not to be considered as limited by the foregoing description, but includes any equivalents.

What is claimed is:

1. A waist fitness apparatus comprising a main body and a resilient cover, wherein the main body has a base pivotally connected with a supporting board through an eccentric unit, and the base is used to distribute the weight of the user, wherein the resilient cover has a top edge and a bottom edge, which are engaged at an outer periphery of the supporting board and the base respectively, so the eccentric unit between the base and the supporting board is isolated from outside, and the supporting board is guided to a fixed position when it is not used due to the resilience of the cover, wherein the eccentric unit has a first connecting rod plugged into a top center portion of the base and a second connecting rod plugged into a bottom center portion of the supporting board; said first connecting rod upwardly protruding from the base while the second connecting rod downwardly protruding from the supporting board; a curved connector configured to connect protruding portions of the first connecting rod and the second connecting rod.

2. The waist fitness apparatus of claim 1, wherein the supporting board is provided for the user to sit on.

3. The waist fitness apparatus of claim 1, wherein the supporting board has a soft seat for the user to sit on to increase the comfort level.

4. The waist fitness apparatus of claim 1, wherein each of the bottom portion of the base and the supporting board has a neck portion respectively, so the bottom edge and top edge of the cover are secured on the neck portions respectively.

5. The waist fitness apparatus of claim 1, wherein the base is larger than the supporting board.

6. The waist fitness apparatus of claim 1, wherein the resilient cover is a cloth cover.

* * * * *